US008548849B1

(12) United States Patent
Porter

(10) Patent No.: US 8,548,849 B1
(45) Date of Patent: Oct. 1, 2013

(54) CUSTOMER GENERATED PROMOTIONS

(75) Inventor: Brandon W. Porter, Auburn, WA (US)

(73) Assignee: Amazon Technologies, Inc., Reno, NV (US)

( * ) Notice: Subject to any disclaimer, the term of this patent is extended or adjusted under 35 U.S.C. 154(b) by 340 days.

(21) Appl. No.: 12/858,876

(22) Filed: Aug. 18, 2010

(51) Int. Cl.
*G06Q 30/00* (2012.01)

(52) U.S. Cl.
USPC ..... 705/14.17; 705/14.13; 705/14.16; 705/14.21; 705/14.72

(58) Field of Classification Search
USPC ..... 705/14.13, 14.16, 14.17, 14.21, 14.72
See application file for complete search history.

(56) References Cited

U.S. PATENT DOCUMENTS

| | | | | |
|---|---|---|---|---|
| 6,029,141 | A * | 2/2000 | Bezos et al. | 705/27.1 |
| 2001/0018665 | A1* | 8/2001 | Sullivan et al. | 705/14 |
| 2001/0037241 | A1* | 11/2001 | Puri | 705/14 |
| 2003/0135413 | A1* | 7/2003 | Nishi et al. | 705/14 |
| 2005/0165646 | A1* | 7/2005 | Tedesco et al. | 705/14 |
| 2005/0197899 | A1* | 9/2005 | Veit et al. | 705/14 |
| 2007/0282675 | A1* | 12/2007 | Varghese | 705/14 |
| 2008/0167950 | A1* | 7/2008 | Barki et al. | 705/10 |
| 2009/0259547 | A1* | 10/2009 | Clopp | 705/14.16 |

* cited by examiner

*Primary Examiner* — Scott D Gartland
(74) *Attorney, Agent, or Firm* — Thomas | Horstemeyer, LLP

(57) ABSTRACT

Disclosed are various embodiments for enabling customers to generate promotions. A specification of a promotion is obtained from a user. The promotion provides an incentive for ordering one or more items from a merchant. An electronic commerce application of the merchant is configured to offer the promotion. An account associated with the user is maintained such that a promotion expense is debited from the account relative to a number of orders to which the incentive is applied.

27 Claims, 5 Drawing Sheets

CUSTOMER GENERATED PROMOTIONS

BACKGROUND

It may be desirable for an online merchant to offer promotions on products from time to time. As an example, an online merchant may offer a promotion on a product such that if a customer buys one of the product, the customer can get another one of the product for free. Another promotion may advertise that if the customer buys one of the product, the customer can receive fifty-percent off of one of another product. Many different types of promotions may be used, for example, to increase sales volume for the online merchant.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the disclosure. Moreover, in the drawings, like reference numerals designate corresponding parts throughout the several views.

DETAILED DESCRIPTION

The present disclosure relates to approaches for customers to generate promotions for merchants. Instead of having trained merchandisers handcraft promotions or adopting a computer-generated approach, various embodiments of the present disclosure enable members of the public to try their luck at designing promotions for a merchant. Certain people may have an extraordinary intuition as to which types of promotions for which products will be successful. Each user is provided with an account that may be correlated to the success or failure of the promotions of the user. Rewards may be provided for successful promotions to foster continued development of successful promotions on a larger scale. In the following discussion, a general description of the system and its components is provided, followed by a discussion of the operation of the same.

Figure 1:
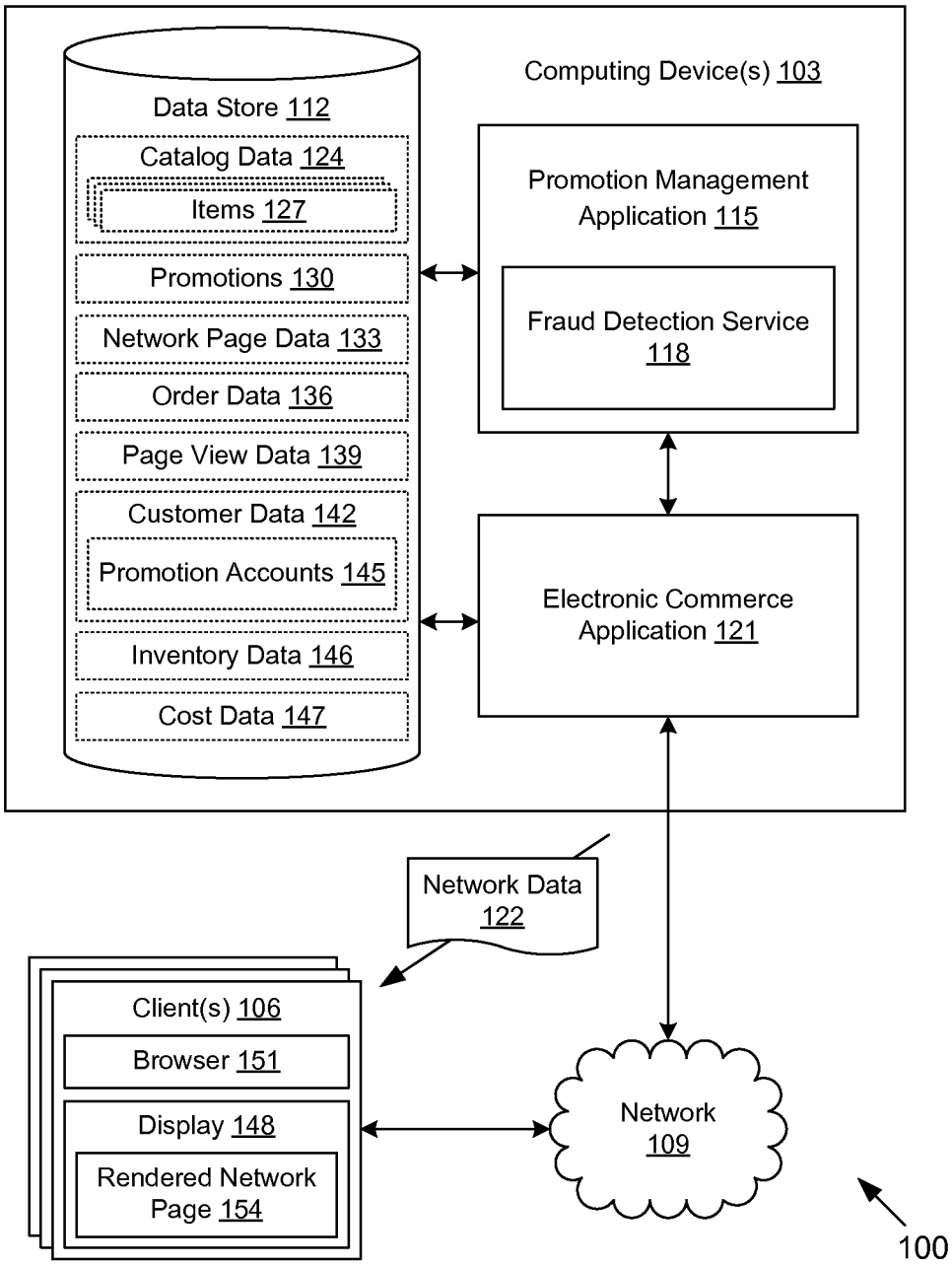
FIG. 1 is a drawing of a networked environment according to various embodiments of the present disclosure.

With reference to FIG. 1, shown is a networked environment 100 according to various embodiments. The networked environment 100 includes one or more computing devices 103 in data communication with one or more clients 106 by way of a network 109. The network 109 includes, for example, the Internet, intranets, extranets, wide area networks (WANs), local area networks (LANs), wired networks, wireless networks, or other suitable networks, etc., or any combination of two or more such networks.

The computing device 103 may comprise, for example, a server computer or any other system providing computing capability. Alternatively, a plurality of computing devices 103 may be employed that are arranged, for example, in one or more server banks or computer banks or other arrangements. For example, a plurality of computing devices 103 together may comprise a cloud computing resource, a grid computing resource, and/or any other distributed computing arrangement. Such computing devices 103 may be located in a single installation or may be distributed among many different geographical locations. For purposes of convenience, the computing device 103 is referred to herein in the singular. Even though the computing device 103 is referred to in the singular, it is understood that a plurality of computing devices 103 may be employed in the various arrangements as described above.

Various applications and/or other functionality may be executed in the computing device 103 according to various embodiments. Also, various data is stored in a data store 112 that is accessible to the computing device 103. The data store 112 may be representative of a plurality of data stores 112 as can be appreciated. The data stored in the data store 112, for example, is associated with the operation of the various applications and/or functional entities described below.

The components executed on the computing device 103, for example, include a promotion management application 115, a fraud detection service 118, an electronic commerce application 121, and other applications, services, processes, systems, engines, or functionality not discussed in detail herein. The promotion management application 115 is executed to obtain promotion specifications from a user and implement promotions according to the promotion specifications. The promotion management application 115 is also executed to maintain accounts for each user that track the success or failure of the promotion. The fraud detection service 118 is executed to determine whether promotions may be fraudulent or meet criteria associated with fraudulent behavior.

The electronic commerce application 121 is executed in order to facilitate the online purchase of items from the network site of a merchant over the network 109. The electronic commerce application 121 also performs various backend functions associated with the online presence of a merchant in order to facilitate the online purchase of items as will be described. For example, the electronic commerce application 121 generates network data 122 such as, for example, network pages, web pages, text messages, banner advertisements, email messages, social networking communications, and/or other types of network content that are provided to clients 106 for the purposes of promoting and selecting items for purchase, rental, download, lease, or any other forms of consumption.

The data stored in the data store 112 includes, for example, catalog data 124 including data relating to items 127, data relating to promotions 130, network page data 133, order data 136, page view data 139, customer data 142 including data relating to promotion accounts 145, inventory data 146, cost data 147, and potentially other data. Catalog data 124 includes data related to a catalog of items 127 offered by one or more merchants through a network site. An item 127 may refer to a product, good, service, software download, multimedia download, social networking profile, or any combination, bundle, or package thereof, that may be offered for sale, purchase, rental, lease, download, and/or any other form of consumption as may be appreciated. The various data stored in catalog data 124 may include titles, descriptions, quantities, images, options, weights, customer reviews, customer ratings, keywords, shipping restrictions, prices, tax classifications, categories, unique identifiers, and any other data related to items 127.

The promotions 130 provide incentives for ordering one or more items 127 from a merchant. As non-limiting examples, a promotion 130 may provide a discounted price for an item 127, free or upgraded shipping, a free item 127, favorable financing, rebates, future discounts, or some other type of incentive when a condition is met. Non-limiting examples of such conditions may include buying an item 127 within a predefined time period, buying a predefined quantity of an item 127, buying groups of different items 127 together, and so on. The promotions 130 may also be associated with advertising campaigns wherein a promotion 130 may be featured on the network site of the merchant or other network sites according to parameters. The promotions 130 are defined by specifications that are uploaded by users.

The network page data 133 includes data used in generating the network data 122 such as network pages. Such data may include templates, graphics, text, client-side code, style sheets, and so on. The order data 136 includes data related to orders placed by customers of the merchant. Such data may include the items 127 that the customer ordered, the promotions 130 applied to the order, shipping addresses, customer identifiers, the time that the order was placed, clickstream data, etc. The page view data 139 includes data related to network pages viewed by customers. To this end, the page view data 139 may comprise, or may be generated from, logs from network page servers. In particular, the page view data 139 may indicate whether an advertisement of a promotion 130 was presented to a customer, whether a network page describing a promotion 130 was clicked on, etc.

The customer data 142 may include data relating to customers of the merchant, such as items 127 that have been ordered by the customer, network pages that have been viewed by the customer, addresses, contact information, shipping preferences, wish lists, security credentials, and other data. Specifically, the customer data 142 may include a promotion account 145 associated with a respective customer. The promotion account 145 keeps track of an amount tied to the success or failure of one or more promotions 130 of the respective customer. The amount in the promotion account may be, for example, a value in a virtual currency, a value in a real currency, or some other value.

The inventory data 146 may describe quantities of the items 127 that are available in inventory to be ordered. Such items 127 may be stocked within a fulfillment network, in transit to a materials handling facility, offered by other vendors for drop shipping, and/or available from other locations. The cost data 147 may describe the costs associated with the items 127. Such costs may comprise wholesale costs, storage costs, handling costs, and/or other factors. In one embodiment, the costs described by the cost data 147 may correspond to the minimum prices that the merchant is willing to accept for the items 127.

The client 106 is representative of a plurality of client devices that may be coupled to the network 109. The client 106 may comprise, for example, a processor-based system such as a computer system. Such a computer system may be embodied in the form of a desktop computer, a laptop computer, a personal digital assistant, a cellular telephone, a smartphone, a set-top box, music players, web pads, tablet computer systems, game consoles, electronic book readers, or other devices with like capability. The client 106 may also include a display 148. The display 148 may comprise, for example, one or more devices such as cathode ray tubes (CRTs), liquid crystal display (LCD) screens, gas plasma-based flat panel displays, LCD projectors, or other types of display devices, etc.

The client 106 may be configured to execute various applications such as a browser 151 and/or other applications. The browser 151 may be executed in a client 106, for example, to access and render network data 122 such as network pages or other network content served up by the computing device 103 and/or other servers, thereby generating a rendered network page 154 on the display 148. The client 106 may be configured to execute applications beyond the browser 151 such as, for example, email applications, instant message applications, and/or other applications.

Next, a general description of the operation of the various components of the networked environment 100 is provided. To begin, a user registers with the promotion management application 115 to establish a promotion account 145. The user interface for establishing and managing the promotion account 145 may be through a network page generated and served up by the promotion management application 115, the electronic commerce application 121, or some other application. In other embodiments, the user interface may comprise a thin or thick client application executing on the client 106, a telephone interface, a text message interface, or some other interface.

In various embodiments, the user may be provided with a complimentary initial amount of virtual currency in the promotion account 145 when the promotion account 145 is created. Such complimentary amounts of virtual currency may be credited periodically to the promotion account 145 in some embodiments. In various embodiments, the user may charge up the promotion account 145 by making a payment to the merchant in a real currency through a payment instrument such as, for example, a check, credit card, debit card, bank note(s), etc. In some cases, a user may be able to earn amounts in virtual currency by performing tasks.

The user may then craft a promotion 130 by defining a specification for the promotion 130. The specification may define the time periods during which the promotion 130 is active, incentives to be applied to orders, conditions for the promotion 130 including the items 127 that are involved, targeting criteria, and/or other features of promotions 130. The incentives associated with a promotion 130 will be associated with a cost that may be designated by the merchant in some cases. Such a cost may or may not be equal to the discount, retail price, or other apparent value of the incentive associated with the promotion 130. Targeting criteria generally specifies the users that should receive the promotion based, by way of example only, on user behavior, purchasing history, geographic location, affiliations, and the like.

The user may also design an advertising campaign for the promotion 130, which may be submitted as part of the specification for the promotion 130. As a non-limiting example, the user may be able to request that the promotion 130 be highlighted or featured on a category network page of the network site of the merchant or some other network site at certain times and/or under other conditions. A cost for featuring the promotion 130 on the particular category network page may be designated by the merchant. The cost may be calculated, for example, per impression, per click-through, per time period, or according to another metric.

The promotion management application 115 receives the specification of the promotion 130 from the client 106 by way of the network 109. The promotion management application 115 proceeds to analyze the specification to determine whether the promotion 130 is acceptable. As a non-limiting example, the promotion 130 may conflict with another scheduled promotion 130 insofar as scheduled time period, incentives, items 127 involved, and/or other characteristics are concerned. The promotion management application 115 may impose other limits on the incentives such as maximum price reduction, minimum price of an item 127 relative to cost, minimum quantities of an item 127 for a certain type of incentive, minimum total of an order for a certain type of incentive, and/or other limits.

The fraud detection service 118 may also perform an analysis on the specification of the promotion 130 to determine whether any indicators of possible fraudulent activity are present. As a non-limiting example, if the incentive is overly generous toward items 127 often purchased by the user and would quickly wipe out the promotion account 145, the fraud detection service 118 may determine that possible fraudulent activity is present. Accordingly, the promotion 130 may be suspended or canceled in some embodiments. In some embodiments, the promotion 130 may be subjected to a manual review by an agent to determine whether indicators of possible fraudulent activity are present.

If the promotion management application 115 deems the promotion 130 to be acceptable, the promotion 130 may be activated for the electronic commerce application 121 to offer the promotion 130 through a network site or other communication medium of the merchant. The promotion 130 may be featured on detail network pages, category network pages, gateway network pages, and/or other network pages in the network site of the merchant and on other network sites as desired.

As the promotion 130 is offered to customers of the merchant and the associated incentive(s) are applied to orders, the corresponding cost of the incentive(s) is debited from the promotion account 145 of the user. If the account balance of the promotion account 145 of the user meets or falls beneath a threshold, the promotion 130 may be suspended until additional currency is credited to the promotion account 145. Such a threshold may be zero, a minimum positive value, a minimum negative value, or another value as desired.

Other data may be obtained in order to determine whether a promotion 130 should be suspended. As a non-limiting example, a promotion 130 on an item 127 that is performing poorly relative to another promotion 130 on the same item 127 may be suspended. As another non-limiting example, after a predefined time period, the results of a promotion 130 may be evaluated with respect to a minimum result predicted by historical data. Various other rules and criteria may be employed to evaluate the results of a promotion 130 at intervals or on a continuing basis. In various embodiments, a user may be able to create rules and criteria for the suspension of a promotion 130. As a non-limiting example, a user may specify a minimum threshold value for the promotion account 145 after which the promotion 130 is to be suspended or terminated.

It is hoped that the additional profit generated from the promotion 130 would exceed the expenses of the promotion 130 in incentives and advertising. In other words, although offering the promotion 130 may subtract from the profit per item 127 of the merchant, it is hoped that more than enough additional sales of the item 127 would be driven by the promotion 130 to increase the total profit of the merchant. As a non-limiting example, suppose that an item 127 costs the merchant $10 and is normally offered for sale on the network site for $15, thereby resulting in a profit of $5 per item 127. Suppose that the merchant normally sells one hundred of the item 127 every day as a baseline. Thus, the merchant normally makes $500 per day on the item 127.

Continuing with the non-limiting example, a customer may craft a promotion 130 for the item 127 of $4 off per item 127, with the promotion 130 to last for one day. For the merchant to benefit from the promotion 130, the total profit within the day for the item 127 should exceed $500. Under the terms of the promotion 130, the merchant 130 makes $1 per item 127 instead of $4 as is normally the case. Consequently, the merchant would have to sell over five hundred of the item 127 within the day for the total profit to exceed $500.

In order to track and reward successful promotions 130, the promotion account 145 of the customer may be credited with an amount related to the additional profit generated with the promotion 130. In the above example, the merchant may credit the promotion account 145 of the user with the amount exceeding $500. As the promotion account 145 of the user is also debited for the cost of the incentive, the user would need to generate at least $500 to avoid a net loss in the promotion account 145. Although the example does not include advertising expenses and/or other overhead expenses related to the promotion 130, such expenses may be reflected in the cost of the promotion 130.

In various embodiments, the promotion account 145 of the user may be credited with an amount related to the additional profit realized by the merchant from the promotion 130, but the amount need not equal the additional profit. In various embodiments, the user may be able to convert an amount in the promotion account 145 directly to cash, store credit, frequent flyer miles or other earned points, or other types of rewards. Percentages and/or tiers may be applied to the amount in the promotion account 145 and/or the amount credited to the promotion account 145 to reduce the cost of the reward to the merchant. In other embodiments, the merchant may provide recognition and/or other benefits to the user according to the amount in the promotion account 145 of the user.

Furthermore, following one or more successful promotions 130, the promotion management application 115 may permit a user to craft promotions 130 on a larger scale and/or with fewer restrictions. The amount of currency in the promotion account 145 may affect the flexibility of the user to design a promotion 130, but experience also may be a factor. Experience may relate to quantity of past promotions 130, profitability of past promotions 130, unexpected results from past promotions 130, etc. As a non-limiting example, a beginning user may be permitted to create promotions 130 regarding certain types of items 127 but not other types of items 127. Other parameters of the promotion 130 that may be affected by experience may include advertising, available incentives, time duration, and so on. To this end, various rules may be applied by the promotion management application 115 to determine which promotions 130 are deemed acceptable from a given user.

Although the example discussed above is concerned with maximizing profit to the merchant, the merchant may instead want to optimize other results, such as page views, quantities sold, brand and/or merchant recognition, cash flow, etc. Thus, a customized fitness function may be employed to determine the amount to be credited to or debited from the promotion account 145 of the user based on the result obtained. Though the promotion account 145 may be denominated in a real currency, correspondence to a currency is not required. For example, the promotion account 145 balance may correspond to item 127 quantities or other values. The amounts to be credited to or debited from the promotion account 145 may be determined by the promotion management application 115 through analysis of the order data 136, page view data 139, cost data 147, and/or other data. In one embodiment, the promotion management application 115 may be configured to credit a predefined amount to the promotion account 145 when a certain number of items 127 are sold, when a certain number of customers apply the promotion 130 to orders, and/or when other conditions are met.

In one embodiment, the fraud detection service 118 monitors the application of the promotion 130 to orders. For example, the fraud detection service 118 may prevent the promotion 130 from being applied to orders placed by the same customer who created the promotion 130. To this end, the fraud detection service 118 may compare names, shipping addresses, email addresses, internet protocol (IP) addresses, and/or other data to determine whether the customer placing the order is the same customer who created the promotion 130. The fraud detection service 118 may also determine if many of the ordered items 127 are going to the same customers, which may be an indicator of fraud. The fraud detection service 118 may flag such orders, suspend the promotion 130, notify administrators, and/or take other actions to control suspected fraud.

Figure 2:
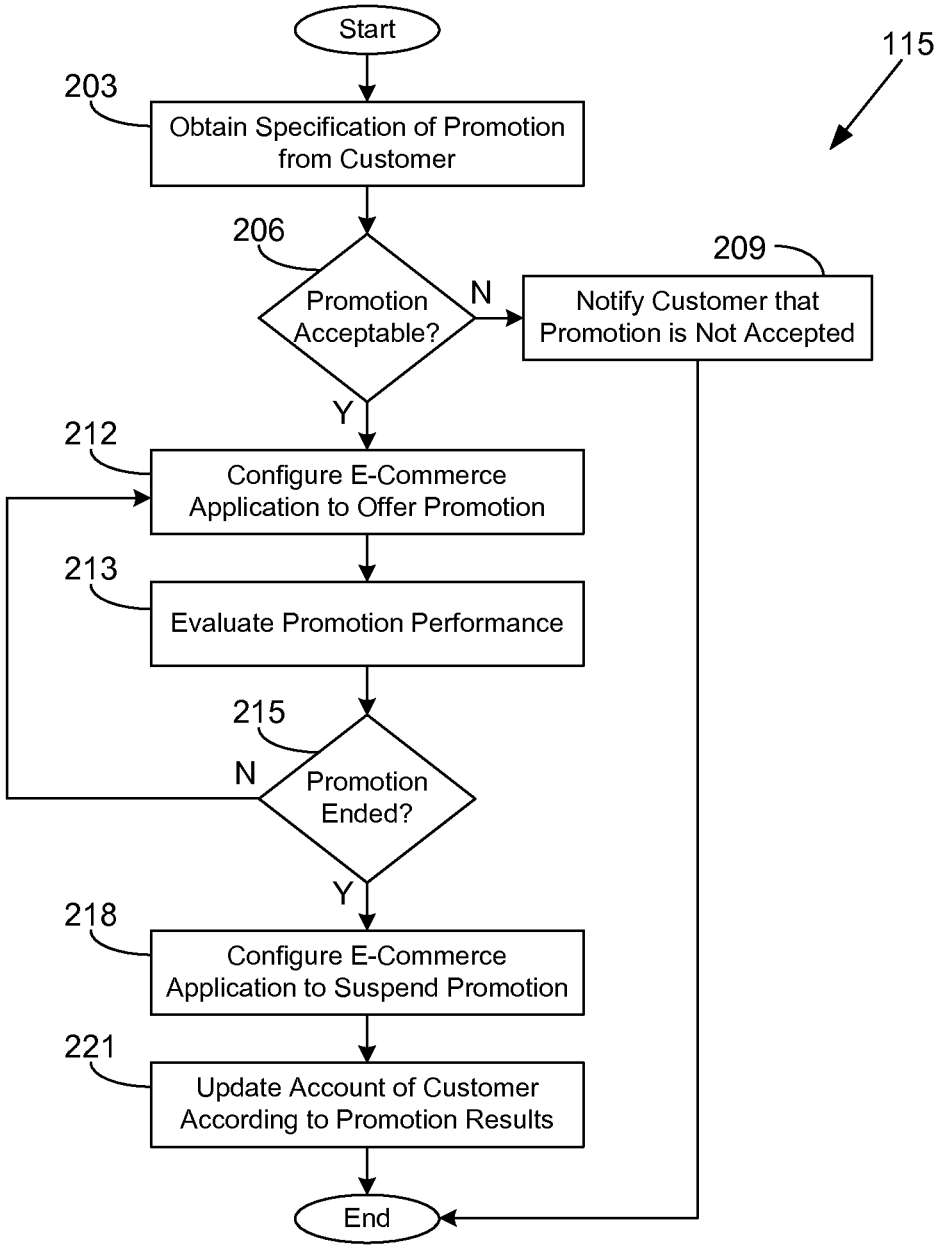
FIG. 2 is a flowchart illustrating one example of functionality implemented as portions of a promotion management application executed in a computing device in the networked environment of FIG. 1 according to various embodiments of the present disclosure.

Referring next to FIG. 2, shown is a flowchart that provides one example of the operation of a portion of the promotion management application 115 according to various embodiments. It is understood that the flowchart of FIG. 2 provides merely an example of the many different types of functional arrangements that may be employed to implement the operation of the portion of the promotion management application 115 as described herein. As an alternative, the flowchart of FIG. 2 may be viewed as depicting an example method implemented in the computing device 103 (FIG. 1) according to one or more embodiments.

Beginning with box 203, the promotion management application 115 obtains a specification of a promotion 130 (FIG. 1) from a customer. In one embodiment, a customer may be presented with a network page having several tools to specify the options for a promotion 130. For example, the customer may specify which items 127 (FIG. 1) are involved, which incentives are offered, the time period during which the promotion 130 is to run, how the promotion 130 is to be advertised, and/or other options. The network page may also specify predicted targets for orders of selected items 127 that the promotion 130 would have to meet or exceed. In other embodiments, the promotion management application 115 may receive a promotion specification provided by a customer via a third-party network site, a data feed, etc.

Next, in box 206, the promotion management application 115 determines whether the promotion 130 specified by the customer is acceptable. As non-limiting examples, the promotion management application 115 may verify whether the incentives associated with the promotion 130 are within predefined bounds, whether the promotion 130 conflicts with other promotions 130, whether the time period is acceptable, whether sufficient credits exists in the promotion account 145 (FIG. 1) of the customer to cover the promotion 130, and/or other characteristics of the promotion 130. In addition, the fraud detection service 118 (FIG. 1) may examine the promotion 130 to determine whether the promotion 130 meets one or more predetermined criteria for fraudulent activity, in which case the promotion 130 would not be deemed acceptable. In some embodiments, the promotion 130 may undergo a manual review by the merchant.

If the promotion 130 is not determined to be acceptable, the promotion management application 115 continues to box 209 and notifies the customer that the promotion 130 is not accepted. In various embodiments, the promotion management application 115 may return a network page to the customer with the notification and an opportunity to make changes to the specification of the promotion 130. In other embodiments, the notification may take the form of an email, text message, telephone call, and/or another form of communication. Thereafter, the portion of the promotion management application 115 ends.

Otherwise, if the promotion 130 is determined to be acceptable, the promotion management application 115 proceeds to box 212 and configures the electronic commerce application 121 (FIG. 1) of the merchant to offer the promotion 130. The promotion 130 may be offered by the electronic commerce application 121 through, for example, network pages of a network site, email messages, text messages, social networking communications, banner advertisements, and other forms of communication. Consequently, various orders that qualify for the promotion 130 may be placed by customers, and incentives may be applied to the orders while the promotion 130 is active.

In box 213, the promotion management application 115 evaluates the performance of the promotion 130. Data may be collected regarding how well the promotion 130 is performing compared with targets, other promotions 130, and/or other rules and criteria that may be defined by the system or the customer. The performance of the promotion 130 may be presented to the customer by way of a dashboard within a network page, emails, text messages, and so on. In response to the performance of the promotion 130, the promotion 130 may be suspended or terminated by the system or the customer. For example, if the inventory data 146 suggests that the inventory of the promoted item(s) 127 will be depleted or otherwise cannot meet the demand, the promotion 130 may be ended prematurely. In this way, a bad promotion 130 may be ended before consuming unnecessary resources, either of the merchant or of the promotion account 145.

In box 215, the promotion management application 115 determines whether the promotion 130 has ended. Such a status check may be performed periodically or in response to some event, such as the placing of an order under the promotion 130 or an event generated by the fraud detection service 118. If the promotion 130 has not ended, the promotion management application 115 returns to box 212, where the electronic commerce application 121 of the merchant is configured to offer the promotion 130.

If the promotion 130 has ended, the promotion management application 115 continues to box 218 and configures the electronic commerce application 121 of the merchant to suspend the promotion 130. In box 221, the promotion management application 115 updates the promotion account 145 of the customer according to the results of the promotion 130. For example, the cost of the incentives associated with the promotion 130 may be debited from the promotion account 145, while the proceeds of the promotion 130 may be credited to the promotion account 145. The proceeds may be determined, for example, according to an additional profit resulting from an actual number of orders covered by the promotion 130, compared to a profit resulting from a baseline number of orders for the associated items 127 predicted to be placed during a time period associated with the promotion 130.

In some embodiments, the promotion account 145 is maintained such that the costs and/or proceeds may be debited or credited upon each order or a batch of orders. In other embodiments, the promotion account 145 is maintained such that the costs and/or proceeds may be reconciled to the promotion account 145 periodically, at the end of the promotion 130, or at another time. Thereafter, the portion of the promotion management application 115 ends.

Figure 3:
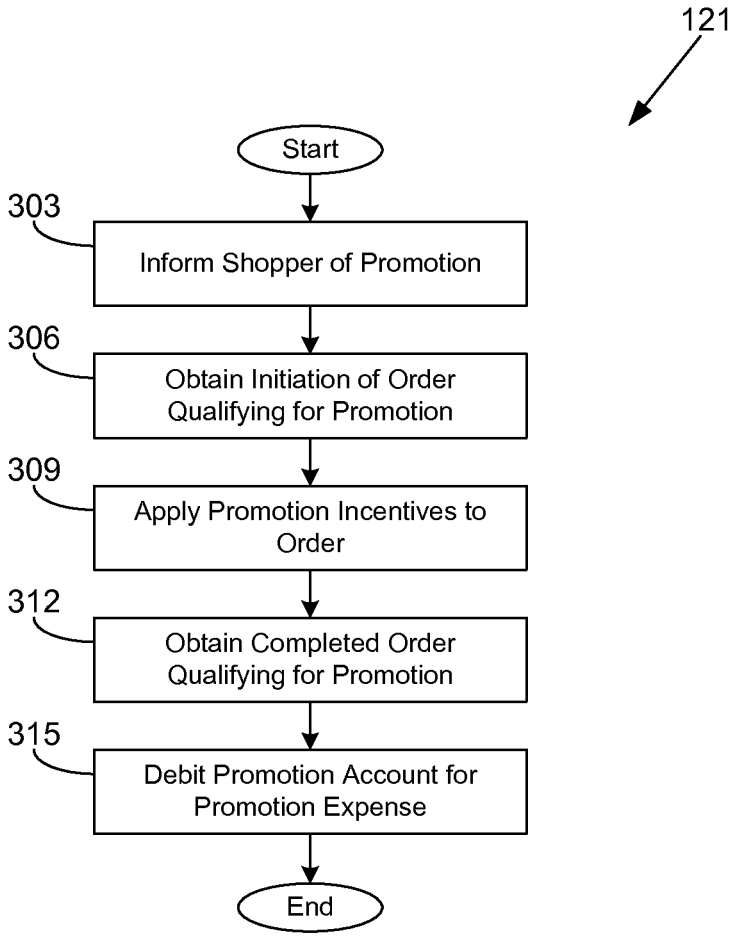
FIG. 3 is a flowchart illustrating one example of functionality implemented as portions of an electronic commerce application executed in a computing device in the networked environment of FIG. 1 according to various embodiments of the present disclosure.

Turning now to FIG. 3, shown is a flowchart that provides one example of the operation of a portion of the electronic commerce application 121 according to various embodiments. It is understood that the flowchart of FIG. 3 provides merely an example of the many different types of functional arrangements that may be employed to implement the operation of the portion of the electronic commerce application 121 as described herein. As an alternative, the flowchart of FIG. 3 may be viewed as depicting an example method implemented in the computing device 103 (FIG. 1) according to one or more embodiments. Although the tasks in the flowchart of FIG. 3 are described as performed by an electronic commerce application 121, it is understood that some or all of the tasks may be performed by the promotion management application 115 in some embodiments.

Beginning with box 303, the electronic commerce application 121 informs a shopper of a promotion 130 (FIG. 1). The shopper may be informed by way of network data 122 such as, for example, a network page, web page, email, text message, banner advertisement, social networking communication. The customer may also be informed by way of a telephone call, print advertisement, broadcast advertisement, and/or other communication media. In box 306, the electronic commerce application 121 obtains an initiation of an order that qualifies for the promotion 130. In box 309, the electronic commerce application 121 applies incentives associated with the promotion 130 to the order. In one embodiment, the electronic commerce application 121 may generate one or more network pages including a shopping basket, where the incentives are reflected in the shopping basket.

In box 312, the electronic commerce application 121 obtains a completed order from the shopper qualifying for the promotion 130. In other words, the payment for the order is submitted or the order is otherwise considered finalized as far as the promotion 130 is concerned. Accordingly, in box 315, the electronic commerce application 121 debits the promotion account 145 (FIG. 1) for the promotion 130 expense. The promotion 130 expense may include advertising expenses, incentive expenses, etc. Thereafter, the portion of the electronic commerce application 121 ends.

Figure 4:
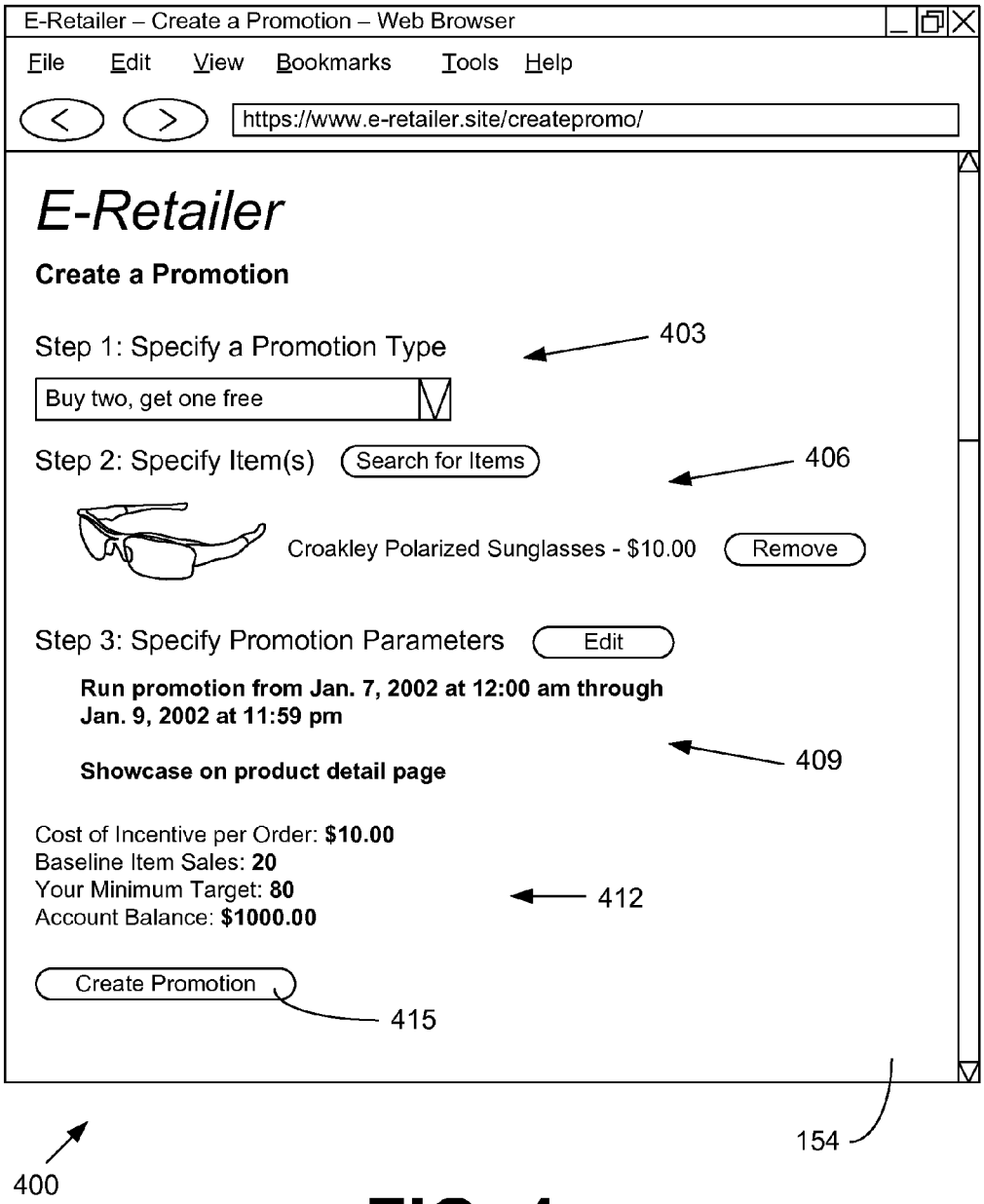
FIG. 4 is a drawing of an example of a user interface rendered by a client in the networked environment of FIG. 1 according to various embodiments of the present disclosure.

Referring next to FIG. 4, shown is a drawing of a user interface 400 rendered in a client 106 (FIG. 1) in the networked environment 100 (FIG. 1) according to various embodiments. In particular, a rendered network page 154 is illustrated that includes an example interface for creating a promotion 130 (FIG. 1). It is understood that the rendered network page 154 illustrates merely one example of many such interfaces. In various embodiments, the user interface 400 may include multiple rendered network pages 154, dynamic network page components, pop-over windows, pop-up windows, etc.

To begin, the rendered network page 154 includes a promotion type specification area 403. The promotion type specification area 403 enables the user to select one type of promotion 130 from many such types. In the illustrated example, a drop-down box is provided for selecting a type of promotion 130, and the type of "buy two, get one free" is selected. Other types may include, for example, "buy one item, get a different item free," "discount on future order," "discount on present order," and so on. In other embodiments, components may be provided for the user to specify various parameters for a type of promotion 130.

An item specification area 406 may also be included to allow the user to specify one or more items 127 (FIG. 1) to be promoted. The item specification area 406 may permit the user to select items 127 by browsing through a category, searching through a catalog, uploading images of the items 127, entering identifiers associated with the items 127, and so on. Various parameters regarding the promotion 130 may be specified in a parameter specification area 409. Such parameters may include, for example, time period for the promotion 130, advertising options for the promotion 130, rules to suspend the promotion 130, types of customers to whom the promotion 130 is to be targeted, and other parameters. The contents of the item specification area 406 and the parameter specification area 409 may depend on the type of promotion 130 selected in the promotion type specification area 403.

A summary area 412 may be provided to display various information about the promotion 130 that is to be created. Such information may include, but is not limited to, cost of promotion 130 incentives, baseline sales of the item(s) 127, sales targets, promotion account 145 balance, and other information. A submit component 415 may be included for submitting the specification of the promotion 130 to the promotion management application 115 (FIG. 1).

Figure 5:
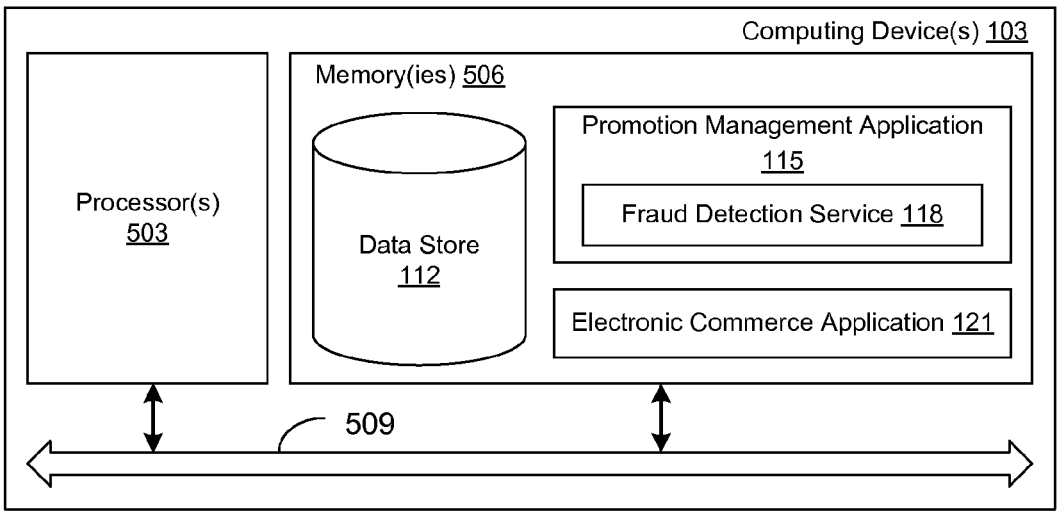
FIG. 5 is a schematic block diagram that provides one example illustration of a computing device employed in the networked environment of FIG. 1 according to various embodiments of the present disclosure.

With reference to FIG. 5, shown is a schematic block diagram of the computing device 103 according to an embodiment of the present disclosure. The computing device 103 includes at least one processor circuit, for example, having a processor 503 and a memory 506, both of which are coupled to a local interface 509. To this end, the computing device 103 may comprise, for example, at least one server computer or like device. The local interface 509 may comprise, for example, a data bus with an accompanying address/control bus or other bus structure as can be appreciated.

Stored in the memory 506 are both data and several components that are executable by the processor 503. In particular, stored in the memory 506 and executable by the processor 503 are the promotion management application 115, the fraud detection service 118, the electronic commerce application 121, and potentially other applications. Also stored in the memory 506 may be a data store 112 and other data. In addition, an operating system may be stored in the memory 506 and executable by the processor 503.

It is understood that there may be other applications that are stored in the memory 506 and are executable by the processors 503 as can be appreciated. Where any component discussed herein is implemented in the form of software, any one of a number of programming languages may be employed such as, for example, C, C++, C#, Objective C, Java, Javascript, Perl, PHP, Visual Basic, Python, Ruby, Delphi, Flash, or other programming languages.

A number of software components are stored in the memory 506 and are executable by the processor 503. In this respect, the term "executable" means a program file that is in a form that can ultimately be run by the processor 503. Examples of executable programs may be, for example, a compiled program that can be translated into machine code in a format that can be loaded into a random access portion of the memory 506 and run by the processor 503, source code that may be expressed in proper format such as object code that is capable of being loaded into a random access portion of the memory 506 and executed by the processor 503, or source code that may be interpreted by another executable program to generate instructions in a random access portion of the memory 506 to be executed by the processor 503, etc. An executable program may be stored in any portion or component of the memory 506 including, for example, random access memory (RAM), read-only memory (ROM), hard drive, solid-state drive, USB flash drive, memory card, optical disc such as compact disc (CD) or digital versatile disc (DVD), floppy disk, magnetic tape, or other memory components.

The memory 506 is defined herein as including both volatile and nonvolatile memory and data storage components. Volatile components are those that do not retain data values upon loss of power. Nonvolatile components are those that retain data upon a loss of power. Thus, the memory 506 may comprise, for example, random access memory (RAM), read-only memory (ROM), hard disk drives, solid-state drives, USB flash drives, memory cards accessed via a memory card reader, floppy disks accessed via an associated floppy disk drive, optical discs accessed via an optical disc drive, magnetic tapes accessed via an appropriate tape drive, and/or other memory components, or a combination of any two or more of these memory components. In addition, the RAM may comprise, for example, static random access memory (SRAM), dynamic random access memory (DRAM), or magnetic random access memory (MRAM) and other such devices. The ROM may comprise, for example, a programmable read-only memory (PROM), an erasable programmable read-only memory (EPROM), an electrically erasable programmable read-only memory (EEPROM), or other like memory device.

Also, the processor 503 may represent multiple processors 503 and the memory 506 may represent multiple memories 506 that operate in parallel processing circuits, respectively. In such a case, the local interface 509 may be an appropriate network 109 (FIG. 1) that facilitates communication between any two of the multiple processors 503, between any processor 503 and any of the memories 506, or between any two of the memories 506, etc. The local interface 509 may comprise additional systems designed to coordinate this communication, including, for example, performing load balancing. The processor 503 may be of electrical or of some other available construction.

Although the promotion management application 115, the fraud detection service 118, the electronic commerce application 121, and other various systems described herein may be embodied in software or code executed by general purpose hardware as discussed above, as an alternative the same may also be embodied in dedicated hardware or a combination of software/general purpose hardware and dedicated hardware. If embodied in dedicated hardware, each can be implemented as a circuit or state machine that employs any one of or a combination of a number of technologies. These technologies may include, but are not limited to, discrete logic circuits having logic gates for implementing various logic functions upon an application of one or more data signals, application specific integrated circuits having appropriate logic gates, or other components, etc. Such technologies are generally well known by those skilled in the art and, consequently, are not described in detail herein.

The flowcharts of FIGS. 2 and 3 show the functionality and operation of an implementation of portions of the promotion management application 115 and the electronic commerce application 121. If embodied in software, each block may represent a module, segment, or portion of code that comprises program instructions to implement the specified logical function(s). The program instructions may be embodied in the form of source code that comprises human-readable statements written in a programming language or machine code that comprises numerical instructions recognizable by a suitable execution system such as a processor 503 in a computer system or other system. The machine code may be converted from the source code, etc. If embodied in hardware, each block may represent a circuit or a number of interconnected circuits to implement the specified logical function(s).

Although the flowcharts of FIGS. 2 and 3 show a specific order of execution, it is understood that the order of execution may differ from that which is depicted. For example, the order of execution of two or more blocks may be scrambled relative to the order shown. Also, two or more blocks shown in succession in FIGS. 2 and 3 may be executed concurrently or with partial concurrence. Further, in some embodiments, one or more of the blocks shown in FIGS. 2 and 3 may be skipped or omitted. In addition, any number of counters, state variables, warning semaphores, or messages might be added to the logical flow described herein, for purposes of enhanced utility, accounting, performance measurement, or providing troubleshooting aids, etc. It is understood that all such variations are within the scope of the present disclosure.

Also, any logic or application described herein, including the promotion management application 115, the fraud detection service 118, and the electronic commerce application 121, that comprises software or code can be embodied in any non-transitory computer-readable medium for use by or in connection with an instruction execution system such as, for example, a processor 503 in a computer system or other system. In this sense, the logic may comprise, for example, statements including instructions and declarations that can be fetched from the computer-readable medium and executed by the instruction execution system. In the context of the present disclosure, a "computer-readable medium" can be any medium that can contain, store, or maintain the logic or application described herein for use by or in connection with the instruction execution system. The computer-readable medium can comprise any one of many physical media such as, for example, magnetic, optical, or semiconductor media. More specific examples of a suitable computer-readable medium would include, but are not limited to, magnetic tapes, magnetic floppy diskettes, magnetic hard drives, memory cards, solid-state drives, USB flash drives, or optical discs. Also, the computer-readable medium may be a random access memory (RAM) including, for example, static random access memory (SRAM) and dynamic random access memory (DRAM), or magnetic random access memory (MRAM). In addition, the computer-readable medium may be a read-only memory (ROM), a programmable read-only memory (PROM), an erasable programmable read-only memory (EPROM), an electrically erasable programmable read-only memory (EEPROM), or other type of memory device.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. A system, comprising:

at least one computing device; and a promotion management application executable in the at least one computing device, the promotion management application comprising:

logic that obtains a specification of a promotion from a first customer who submits the promotion specification to a merchant, the promotion providing an incentive to a second customer of the merchant for ordering at least one item from the merchant;

logic that configures an electronic commerce application of the merchant to enable the promotion; and logic that debits a promotion expense from an account associated with the first customer, the promotion expense based at least in part on a cost associated with the incentive.

2. The system of claim 1, wherein the specification of the promotion selects at least one advertising option for the promotion.

3. The system of claim 2, wherein the promotion management application further comprises logic that debits an advertising expense from the account, the advertising expense being associated with the at least one advertising option.

4. The system of claim 1, wherein the logic that configures the electronic commerce application further configures the electronic commerce application of the merchant to enable the promotion during a time period.

5. The system of claim 1, wherein the logic that configures the electronic commerce application further configures the electronic commerce application of the merchant to enable the promotion responsive to a manual review of the promotion by the merchant.

6. The system of claim 1, wherein the promotion management application further comprises logic that rejects the promotion when the promotion conflicts with another promotion.

7. The system of claim 1, wherein the promotion management application further comprises:

logic that determines whether the promotion meets at least one predetermined criterion for fraudulent activity; and logic that suspends the promotion when the promotion meets at least one predetermined criterion for fraudulent activity.

8. The system of claim 1, wherein the promotion management application further comprises:

logic that processes a payment for a specified amount from the first customer; and logic that credits the account of the first customer in an amount of a virtual currency based at least in part on the specified amount.

9. The system of claim 1, wherein the promotion management application further comprises logic that creates the account for the first customer and credits the account with an initial amount of a virtual currency.

10. The system of claim 1, wherein the promotion management application further comprises logic that suspends the promotion when the account has a balance meeting a threshold.

11. The system of claim 1, wherein the at least one item includes at least a predetermined quantity of a first type of item and at least a predetermined quantity of a second type of item.

12. The system of claim 1, wherein the at least one item includes at least a predetermined quantity of an item.

13. The system of claim 1, wherein the promotion management application further comprises logic that credits the account with an amount of a virtual currency based at least in part on a result of the promotion.

14. The system of claim 13, wherein the result of the promotion is an additional profit resulting from an actual number of orders for the at least one item under the promotion compared to a profit resulting from a baseline number of orders for the at least one item predicted to be placed during a time period associated with the promotion.

15. The system of claim 1, wherein the first customer and the second customer are a same customer.

16. A non-transitory computer-readable medium embodying a program executable in a computing device, comprising:

code that obtains a specification of a promotion from a first customer who submits the promotion specification to a merchant, the promotion providing an incentive to a second customer of the merchant for ordering at least one item from the merchant;

code that configures an electronic commerce application of the merchant to enable the promotion;

code that creates an account associated with the first customer; and code that debits from the account a promotion expense based at least in part on a cost associated with the incentive relative to a number of orders to which the incentive is applied.

17. The computer-readable medium of claim 16, wherein the account is denominated in a virtual currency.

18. The computer-readable medium of claim 17, wherein the account is credited with an initial amount of the virtual currency.

19. A method, comprising:

obtaining, in at least one computing device, a specification of a promotion from a first customer who submits the promotion specification to a merchant;

enabling, in the at least one computing device, a promotion according to the promotion specification through an electronic commerce application of a merchant, the promotion providing an incentive to a second customer of the merchant for ordering at least one item from the merchant; and debiting, in the at least one computing device, a promotion expense from an account associated with the first customer, the promotion expense based at least in part on a cost associated with the incentive.

20. The method of claim 19, further comprising crediting, in the at least one computing device, the account with an initial amount.

21. The method of claim 19, further comprising:

processing, in the at least one computing device, a payment for a specified amount from the first customer; and crediting, in the at least one computing device, the account of the first customer in an amount based at least in part on the specified amount.

22. The method of claim 19, further comprising crediting, in the at least one computing device, the account with an additional profit resulting from an actual number of orders for the at least one item under the promotion compared to a profit resulting from a baseline number of orders for the at least one item predicted to be placed during a time period associated with the promotion.

23. The method of claim 19, further comprising:

determining, in the at least one computing device, whether the promotion meets at least one predetermined criterion for fraudulent activity; and suspending, in the at least one computing device, the promotion when the promotion meets at least one predetermined criterion for fraudulent activity.

24. The method of claim 19, further comprising suspending, in the at least one computing device, the promotion when the account has a balance meeting a threshold.

25. The method of claim 19, further comprising suspending, in the at least one computing device, the promotion when a predetermined time period expires.

26. The method of claim 19, further comprising rejecting, in the at least one computing device, the promotion when the promotion conflicts with another promotion.

27. The method of claim 19, wherein the at least one item includes at least a predetermined quantity of a first type of item and at least a predetermined quantity of a second type of item.

* * * * *